US008216115B2

(12) United States Patent
Lai

(10) Patent No.: US 8,216,115 B2
(45) Date of Patent: Jul. 10, 2012

(54) OVAL TRANSMISSION STRUCTURE

(76) Inventor: Ying-Chou Lai, Huatan Township, Changhua County (TW)

( * ) Notice: Subject to any disclaimer, the term of this patent is extended or adjusted under 35 U.S.C. 154(b) by 64 days.

(21) Appl. No.: 12/791,092

(22) Filed: Jun. 1, 2010

(65) Prior Publication Data

US 2011/0294627 A1 Dec. 1, 2011

(51) Int. Cl.
*A63B 22/00* (2006.01)

(52) U.S. Cl. ..... 482/70; 482/62

(58) Field of Classification Search ..... 482/51, 482/52, 53, 54, 55, 56, 57, 58, 59, 60, 61, 482/62, 63, 64, 65, 70, 71, 79, 80
See application file for complete search history.

(56) References Cited

U.S. PATENT DOCUMENTS

| | | | | |
|---|---|---|---|---|
| 6,390,954 | B1 * | 5/2002 | Lee | 482/52 |
| 7,361,122 | B2 * | 4/2008 | Porth | 482/52 |
| 7,462,135 | B2 * | 12/2008 | Lo | 482/52 |
| 7,670,268 | B1 * | 3/2010 | Stearns et al. | 482/52 |
| 7,704,193 | B2 * | 4/2010 | Liao et al. | 482/57 |
| 7,854,691 | B2 * | 12/2010 | Long et al. | 482/57 |
| 7,946,962 | B2 * | 5/2011 | Long | 482/52 |
| 7,972,248 | B2 * | 7/2011 | Liao et al. | 482/52 |
| 8,062,186 | B2 * | 11/2011 | Nelson et al. | 482/52 |
| 2006/0223678 | A1 * | 10/2006 | MacLean | 482/51 |

* cited by examiner

*Primary Examiner* — Loan Thanh
*Assistant Examiner* — Tam Nguyen
(74) *Attorney, Agent, or Firm* — Jackson IPG PLLC

(57) ABSTRACT

An oval transmission structure utilizes lower ends of swaying moving shafts at two sides thereof to pivot to front ends of push-pull shafts, whose front portions slope to a determined angle. Rear portions of the push-pull shafts offer treadle frames for treadles to dispose with feet. Rear portions of the push-pull shafts further offer a track frame. An assistant device provides a sliding block with a fixing bolt superimposed at a side of the lower portion of the swaying moving shaft. An attached shaft pivoted to a side of the sliding block connects to an axle bolt of a transmission shaft, whose front end axially connects to a crank, whose rear end serially connects to a track wheel and whose middle determined position disposes a sliding wheel thereunder. The reciprocation brought about by the feet, the two cranks axially trigger the front ends of the two transmission shaft for achieving a relative oval action. The axle bolt motivates the attached shaft for driving the sliding block to move the lower portions of the two swaying moving shafts to achieve a relative displacement. Concurrently, the sliding wheel reciprocating flat on the track frame permits upper portions of the swaying moving shafts to sway oppositely. The two treadle frames accordingly slide on the track wheels. A V-shaped leverage of the transmission shaft could attain a favorable transmission effect in time of users operating the back-and-forth reciprocation.

6 Claims, 10 Drawing Sheets

Fig. 4-A

OVAL TRANSMISSION STRUCTURE

BACKGROUND OF THE INVENTION

1. Field of the Invention

The present invention relates to an oval transmission structure, in particular to a reciprocating movement brought about by both hands and feet, and in particular to an oval transmission structure that could simulate the mounting motion and freely adjust the swaying scope.

2. Description of the Related Art

A general oval exercising device mainly utilizes the hand-controlled swaying moving shafts to axially motivate the push-pull shafts that are disposed by treadles for achieving a back-and-forth movement. Since the other end of the push-pull shaft pivots to a crank, the movement thereof is shown as an oval back-and-forth reciprocation. Thus, the effect of riding a bicycle is also achieved.

However, the existing oval exercising device has the following shortcomings:

1. The existing oval exercising device provides the back-and-forth treading reciprocating movement in accordance with the predetermined oval rotating scope as well as the swaying scope. The existing oval exercising device is unable to be adjusted for suiting to every individual and his appropriate exercising consumption. Moreover, in time of the initial treading, users have to tread on the treadle beyond an operating threshold limit value to continue the treading. As a result, the existing configuration can merely suit to part of the body.

2. The existing oval exercising device mostly simulates the motion of riding a bicycle. Namely, other interesting exercising manners are hardly to be achieved. Thus, the only bicycle riding motion may be prosaic, thence decreasing the motivation to continuously operate the exercising device. Further, the fundamental base of the exercising device is rather long, thereby occupying large space and increasing the cost.

3. The existing oval exercising device mainly adopts the integral swaying moving shafts. Therefore, the swaying range brought about by both hands and feet would accordingly vary in accordance with the different positions of the axle center. Namely, if the axle center is low, the swaying range of both hands is large while the swaying range of feet is accordingly small. Oppositely, if the axle center is high, the swaying range of both hands is small while the swaying range of feet is accordingly large. Obviously, the existing oval exercising device is unsuited to every age group.

SUMMARY OF THE INVENTION

The object of the present invention is to provide an oval transmission structure that utilizes both hands and feet to achieve the reciprocation for concurrently simulating a mounting motion and adjusting a swaying range thereof.

The oval transmission structure comprises swaying shafts disposed at two sides thereof having their lower ends axially connected to front portions of push-pull shafts whose front end slopes to a predetermined angle. Rear portions of the push-pull shafts provide treadle frames for treadles to dispose and for feet to tread on the treadles. An assistant device provides a sliding block with a fixing bolt superimposed at a side of a lower portion of the swaying moving shaft. At a side of the assistant device, an attached shaft connects to an axle bolt of a transmission shaft. A front end of the transmission shaft axially connects to a crank. A rear end of the transmission shaft serially connects to a track wheel for the treadle frame to straddle thereon. The transmission shaft provides a sliding wheel beneath a predetermined position at a middle portion thereof. Thereby, users adjust the sliding block superposed on the swaying moving shaft to a desired position that decides a back-and-forth reciprocating range of the treadles. Accordingly, the fixing bolt at a side spirally fixes the sliding block. With the cooperation of the front end of the transmission shaft pivoting to the crank, the motion of the entire structure presents an oval movement. The track frame could be either disposed flat to a main shaft or fixed to the main shaft. Thence, the reciprocating treading from the feet permits the two cranks to axially motivate two front ends of the two transmission shafts for achieving a relative oval action. The axle bolt thence triggers an attached shaft and the sliding wheels thereunder to achieve a reciprocal slip on the track frame, thereby allowing the lower portions of the two swaying moving shafts driven by the sliding block to achieve a relative displacement. Additionally, the upper portions of the two swaying moving shafts sway in the different directions to pivotally motivate the slip of the treadle frame on the track wheels. As a result, a V-shaped leverage of the transmission shaft is accomplished to attain a favorable transmission effect while an alternation of the reciprocating treading and swaying of the treadles and the swaying moving shafts is executed.

Preferably, at a rear portion of the oval transmission structure, a track frame is axially disposed for being arranged with a block including at least one slot to form a sloping frame. Alternatively, the track frame could be directly fixed to the block to form a sloping frame. Thereby, the reciprocal treading from the both feet allows the two cranks to axially motivate the front ends of the two transmission shafts for achieving a relative oval action. The axle bolt on the other hand triggers the attached shaft and the sliding wheel thereunder for accomplishing the reciprocal rising and falling motion on the track frame, so that the sliding block is brought about to move the lower portions of the two swaying moving shafts for attaining the relative displacement. The upper portions of the two swaying moving shafts thence sway oppositely, and the treadle frames are axially motivated to slide on the track wheels, thereby allowing the treadles to accordingly rise and fall. Thus, users are able to simulate the mountain climbing action afoot.

Preferably, the attached shaft pivots to the predetermined position at a side of the lower portion of the shaving shaft so as to connect to the axle bolt of the transmission shaft. Moreover, at two sides of the top end of the oval transmission structure, secondary shafts are pivoted to axle bolts. Thus, in time of the reciprocation being achieved by feet, the two cranks axially motivate the front ends of the two transmission shafts for accomplishing the relative oval actions. Thereby, the axle bolt brings the attached shaft and the secondary shaft to trigger the lower portions of the two swaying moving shafts for attaining the relative displacement. The upper portion of the swaying moving shafts thence sways oppositely so as to pivotally drive the treadle frames to slide on the track wheels. The secondary shaft sways along with a moving route of the push-pull shaft for effectively bearing the weights of both user and entire components. As a result, a stable back-and-forth reciprocation is achieved.

Preferably, the two-sectional swaying moving shaft includes an upper holding shaft and a lower swaying shaft, respectively. The upper holding shaft pivots to two sides of the top middle of the oval transmission structure, thereby allowing an apertured board to be downwardly extended through an axle tube. The lower swaying shaft pivots to two sides of the top front of the oval transmission structure. An adjusting board is pivoted to a side of the top portion of the lower swaying shaft. Thereby, a latch shaft respectively enters into apertures on the apertured board as well as through holes on the adjusting board, thence permitting a tight connection. While the feet reciprocally tread on the treadles, the two cranks axially trigger front portions of the two transmission shafts, thereby allowing a relative oval action. The axle bolt drives the attached shaft and then triggers the sliding block to move the two lower swaying shafts for achieving a relative displacement. The adjusting board thereabove cooperates with the apertured board to propel the upper holding shaft for presenting an opposite swaying, so that the treadle frames are pivotally triggered to slide on the track wheels. Thus, a V-shaped leverage of the transmission shaft is accomplished to attain a favorable transmission effect while an alternation of the reciprocating treading and swaying of the treadles and the swaying moving shafts is executed.

BRIEF DESCRIPTION OF THE DRAWINGS

FIG. 4-A is a schematic view showing the track frame and the block in assemblage;

DETAILED DESCRIPTION OF THE PREFERRED EMBODIMENTS

Figure 1:
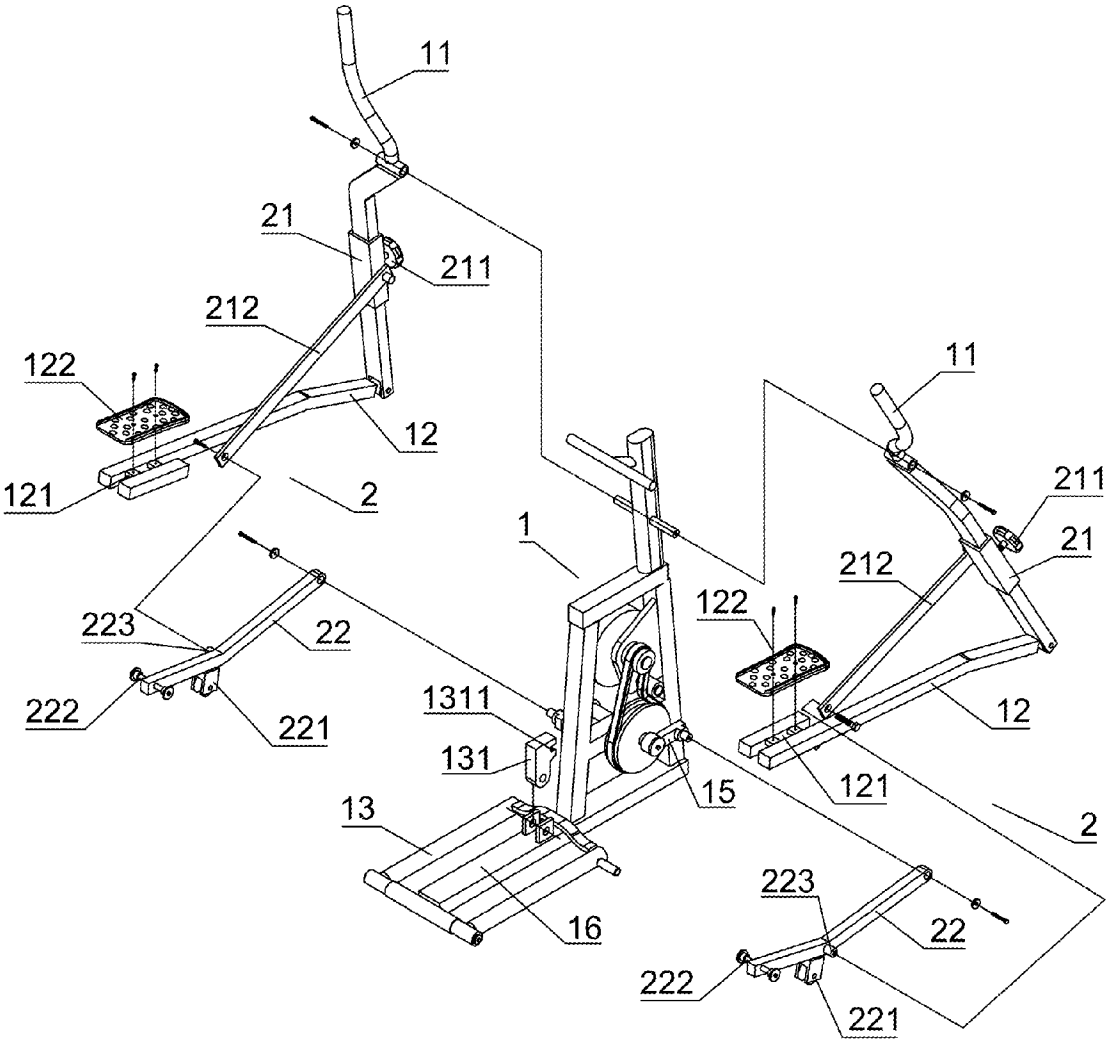
FIG. 1 is an exploded view of the present invention.
Figure 2:
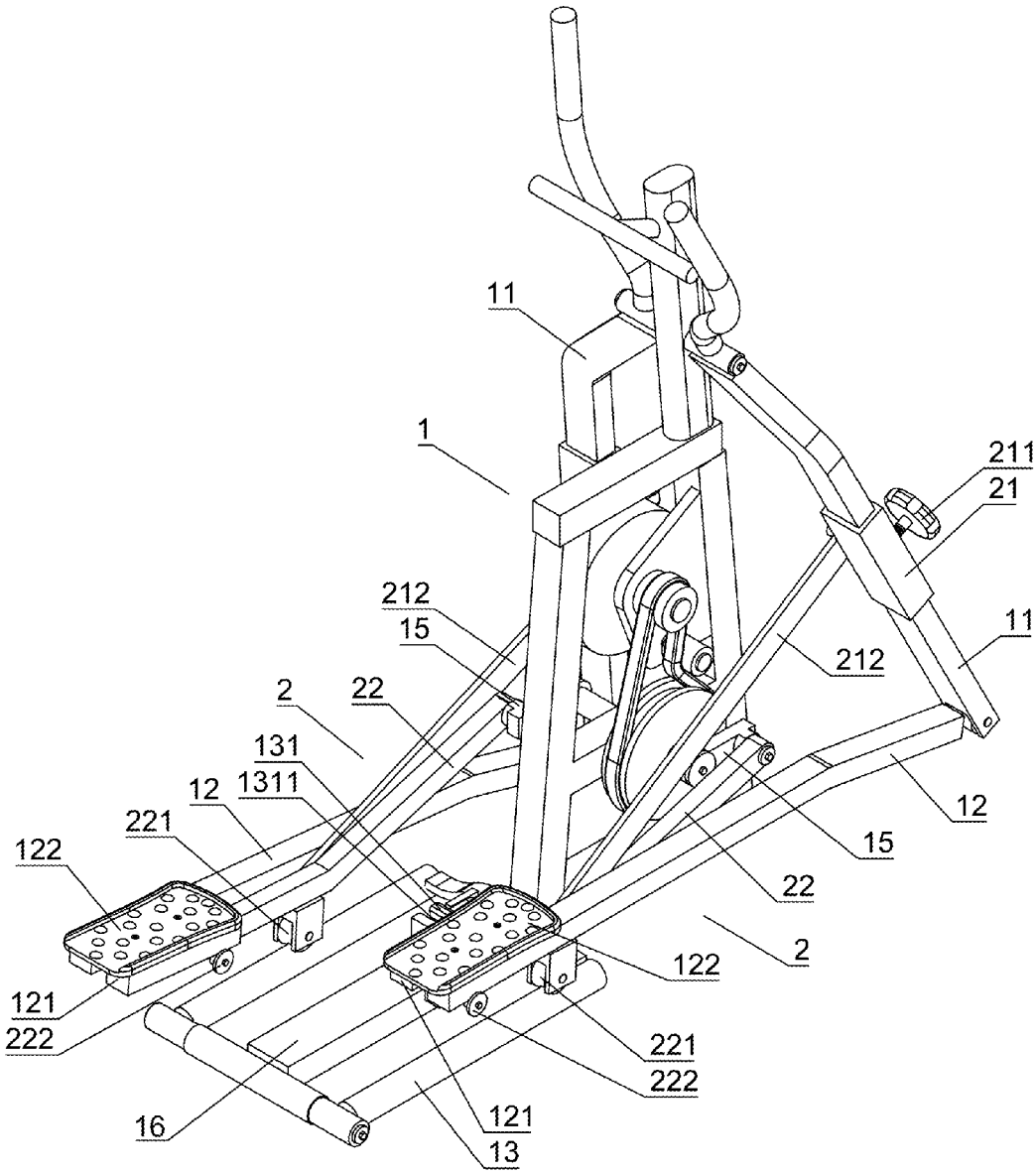
FIG. 2 is a perspective view showing a first preferred embodiment of the present invention.
Figure 3:
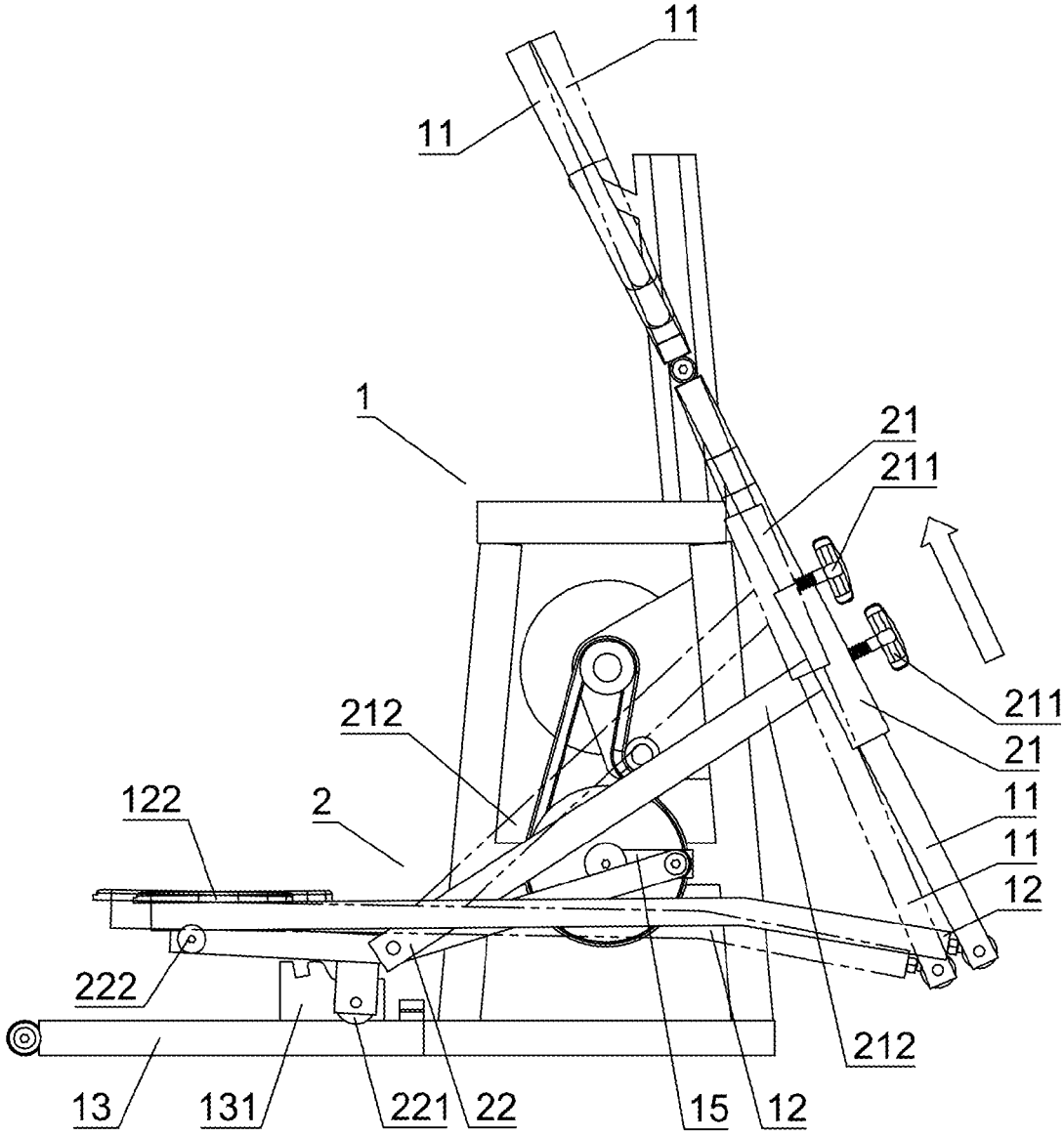
FIGS. 3 is a schematic view showing a sliding block of the present invention in adjusting.
Figure 7:
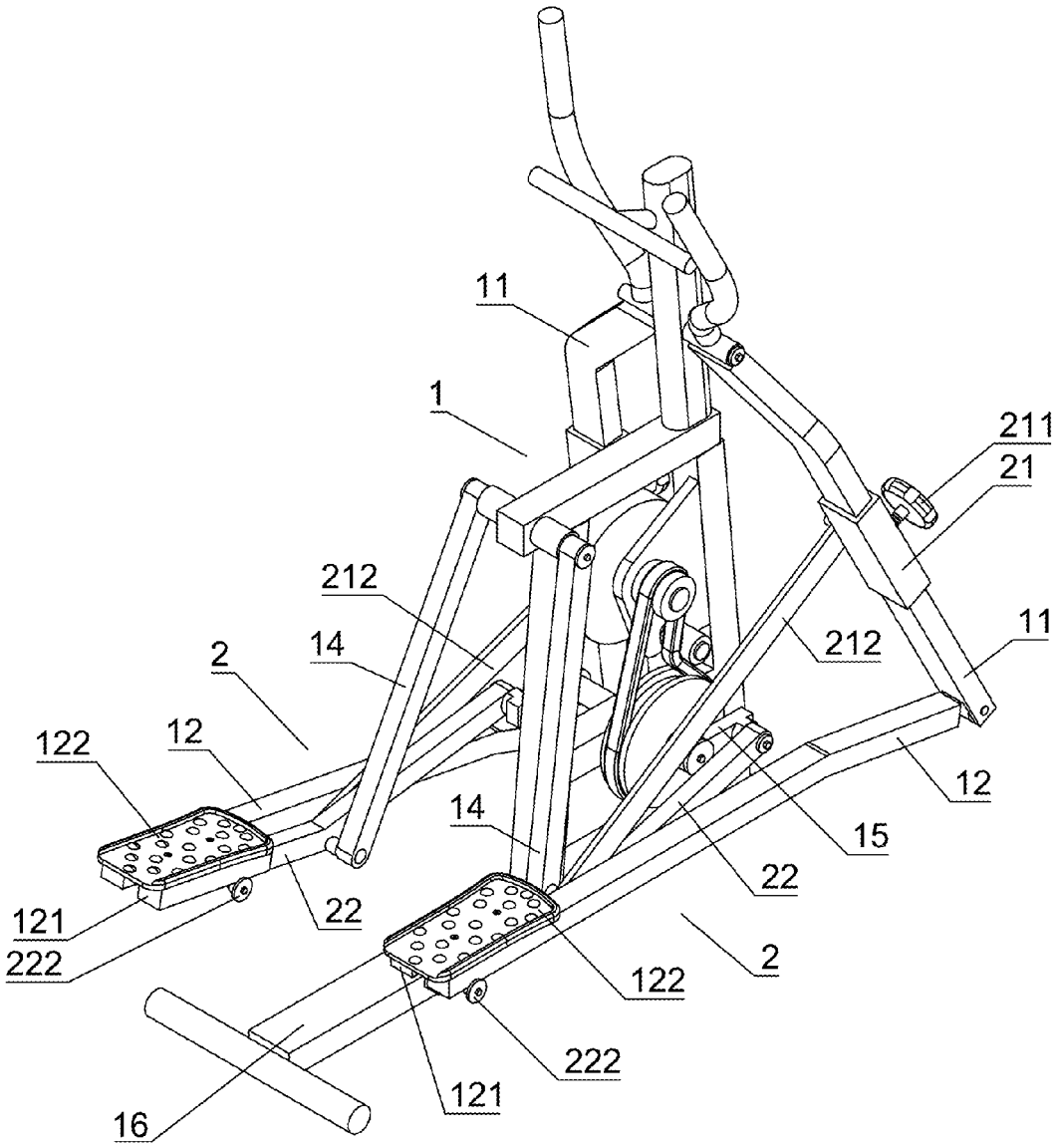
FIG. 7 is a perspective view showing a third preferred embodiment of the present invention.

Referring to FIGS. 1 to 3, an oval transmission structure comprises a platen base 1 and an assistant device 2. The platen base 1 is mainly structured by an oval exercising device. The platen base 1 includes integral swaying moving shafts 11 disposed at two sides thereof for hands to support. Wherein, the swaying moving shaft 11 adopts either an integral shaft or a two-sectional shaft. Lower portions of the swaying moving shaft 11 axially connect to front ends of push-pull shafts 12, respectively. The front portions of the push-pull shafts 12 slope to a predetermined angle, and at rear portions of the push-pull shafts 12 dispose treadle frames 121, which arranges treadles 122 thereon capable of the feet treading. Further, the treadle frames 121 straddle on track wheels 222 of a transmission shaft 22. A track frame 13 is disposed at a rear portion of the oval transmission structure for permitting the sliding wheels 221 of the transmission shaft 22 to slide thereon. Alternatively, at two sides of a top end of the oval transmission structure, secondary shafts 14 (as shown in FIG. 7) are pivoted to axle bolts 223 at one side in the middle of the transmission shaft 22 for bearing weights. The track frame 13 adopts a frame body axially disposing on an end portion of the platen base 1. A block 131 with at least one slot 1311 is pivoted on a front portion of the track frame 13, thereby forming a sloping frame. Besides, a sloping frame is formed by the track frame 13 directly fixed to a main shaft 16, or by the track frame 13 fixed to the block 131 , thereby permitting the treadles 122 to freely raise and fall or move flat. The assistant device 2 provides a sliding block 21 superposing at a lower portion of the swaying moving shaft 11. A side of the sliding block 21 is mounted with a fixing bolt 211 for adjusting and fixing the sliding block 21. An attached shaft 212 is pivotally disposed on one side of the sliding box 21 and connected to an axle bolt 223 in a side of the middle of the transmission shaft 22. Alternatively, the attached shaft 212 directly pivots to a predetermined position of a lower side of the swaying moving shaft 11 for connecting to the axle bolt 223. A front end of the transmission shaft 22 is pivotally engaged with a crank 15 for controlling the oval rotating range of the treadles 122. A rear end of the transmission shaft 22 is serially connected to a track wheel 222 for the treadle frames 121 to slide thereon and bearing the transmission force. Beneath a predetermined position of a middle section of the transmission shaft 22, a sliding wheel 221 is disposed for sliding on the track frame 13. As a result, the transmission shaft 22 forms a V-shaped leverage in accordance with the three interactions from its front end, the rear end, and the middle. By means of such structure, the swaying motion of the entire structure could be adjusted, and a simulated mountain climbing effect could be also achieved.

Figure 4:
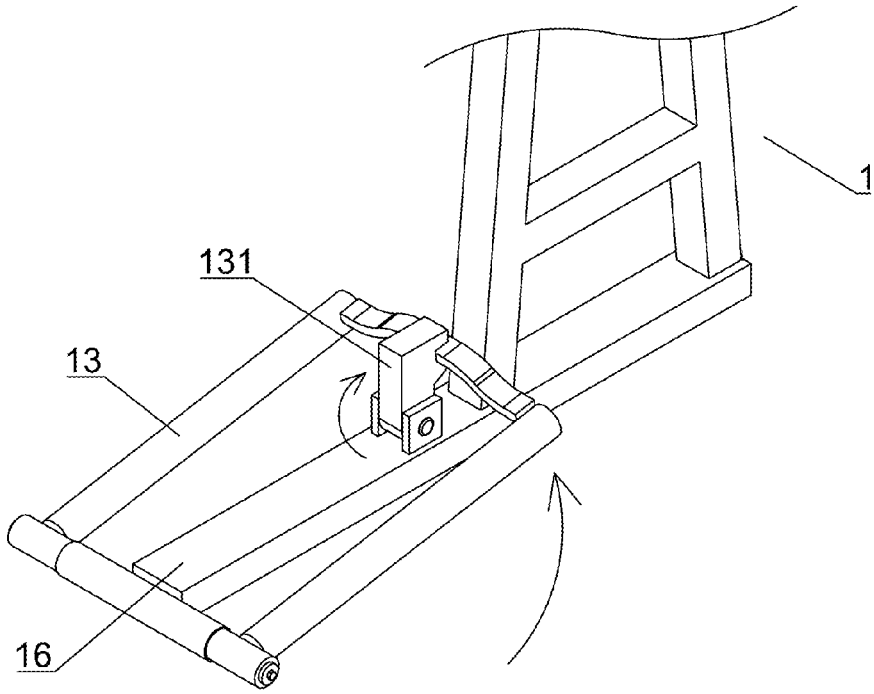
FIG. 4 is a schematic view showing a track frame and a block of the present invention in detachment.
Figure 4:
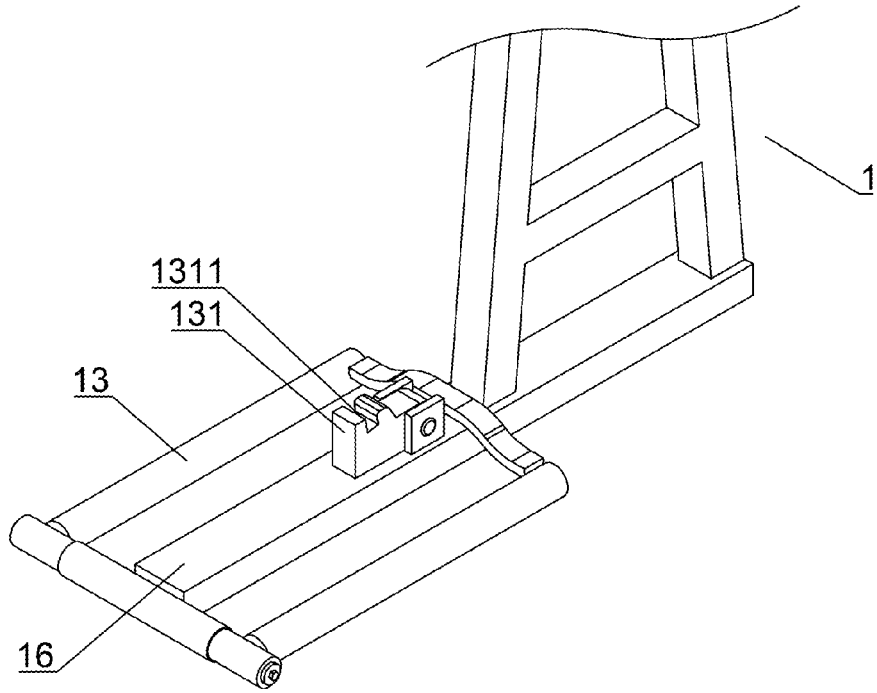

Referring to FIGS. 2 to 4, a first preferred embodiment of the present invention is shown. The range of the reciprocal moving action of the treadles 122 could be adjusted according to users' desire. Namely, the sliding block 21 superimposed on the swaying moving shaft 11 is adjusted to a predetermined position. The predetermined position and the entire motion could be altered in accordance with the varied upward and downward positions. When the desired position is decided, the fixing bolt 211 at the side preferably fastens the sliding block 21. Further by the cooperation of the front end of the transmission shaft 22 pivoting to the crank 15, the moving manner presents an elliptic action. Additionally, the treadle frames 121 are astride on the track wheels 222, and the track frame 13 is disposed flat or fixed to the main shaft 16 (as shown in FIG. 3). While the feet reciprocally tread on the treadles 122, the two cranks 15 axially trigger the front ends of the two transmission shafts 22 in view of the inertia force from the oval transmission structure so as to achieve a relative oval movement. Concurrently, the axle bolt 223 at one side brings the attached shaft 212 and the sliding wheel 221 thereunder to reciprocally move flat on the track frame 13, thereby permitting the sliding block 21 to trigger the lower portions of the two swaying moving shafts 11 to relatively displace. The upper portion of the swaying moving shaft 11 sways oppositely for pivotally motivating the treadle frames 121 on the two push-pull shafts 12 to slide on the track wheels 222 (as shown in FIG. 2). When the crank 15 is rotated to a lowest position, the rear end of the transmission shaft 22 is positioned at a highest point. On the other hand, when the crank 15 is positioned to a highest point, the rear end of the transmission shaft 22 is placed to a lowest position. As a result, a V-shaped leverage of the transmission shaft 22 is accomplished to attain a favorable transmission effect while an alternation of the reciprocating treading and swaying of the treadles 122 and the swaying moving shafts 11 is executed. Thereby, users are permitted to freely adjust the swaying range of the exercising device, so that the back-and-forth reciprocation brought about by the oval transmission structure is suited to each individual.

Figure 5:
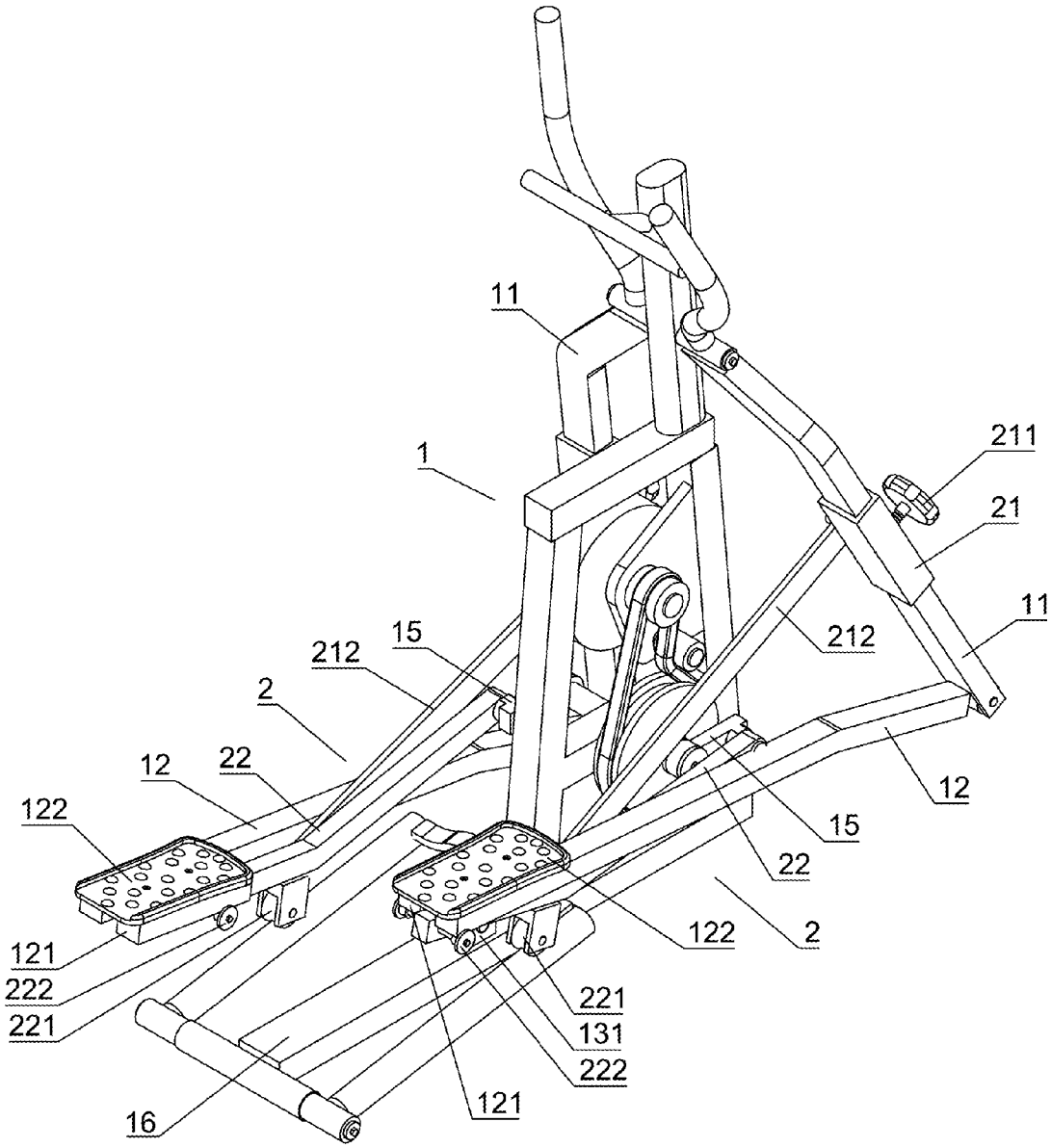
FIG. 5 is perspective view showing a second preferred embodiment of the present invention.
Figure 6:
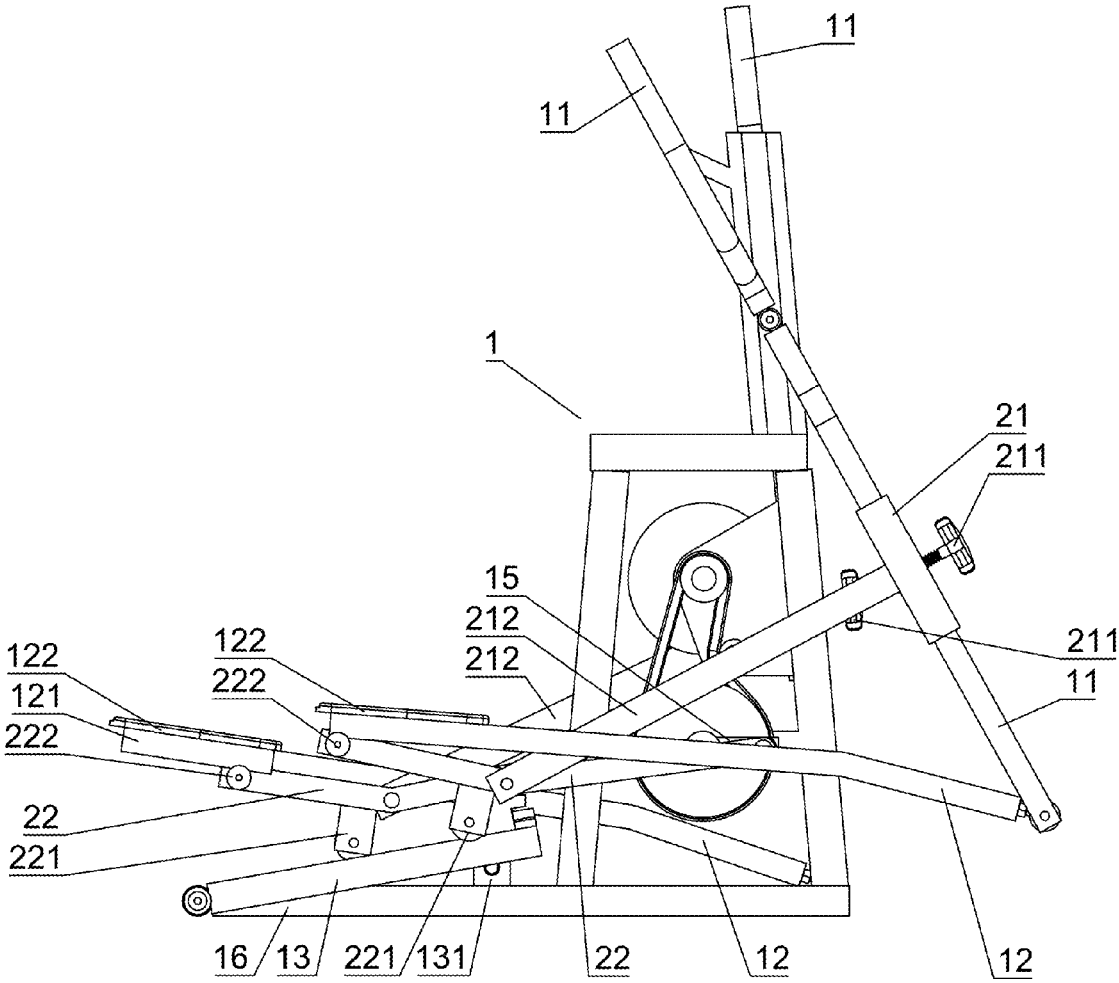
FIG. 6 is a side view showing the second preferred embodiment of the present invention.

Referring to FIGS. 5, 6, and 4-A, a second preferred embodiment of the present invention is designed according to the first preferred embodiment. While lifting the track frame 13 to a certain distance, the track frame 13 is assembled with respect to the slot 1311 of the block 131 for forming a sloping frame (as shown in FIG. 4-A). Or the track frame 13 directly fixes with the block 131 to form a sloping frame. Thereby, a similar free adjustment could be achieved and an analogous oval back-and-forth reciprocation could be accomplished. When the feet reciprocally tread on the treadles 122, the two cranks 15 axially trigger the front ends of the two transmission shafts 22 in view of the inertia force from the oval transmission structure, so that a relative oval action is achieved. Concurrently, the axle bolt 223 at one side brings the attached shaft 212 and the sliding wheel 221 thereunder to reciprocally raise and fall on the track frame 13, thereby motivating the sliding block 21 to move the lower portions of the two swaying moving shafts 11 to relatively displace. As to the upper portions of the swaying moving shafts 11, an opposite swaying motion is presented, thereby pivotally trigger the treadle frames 121 of the two push-pull shafts 12 to slide on the track wheels 222 (as shown in FIGS. 5 to 6). When the crank 15 is moved to the lowest position, the rear end of the transmission shaft 22 stands at its highest point. On the other hand, when the crank 15 is moved to the highest position, the rear end of the transmission shaft 22 stands at its lowest point. Thereby, a V-shaped leverage is accomplished to attain a favorable transmission effect while an alternation of the reciprocating treading and swaying of the treadles 122 and the swaying moving shafts 11 is execute as that in the afore embodiment, so that users could exercise an analogous reciprocation during the mountain climbing afoot.

Figure 8:
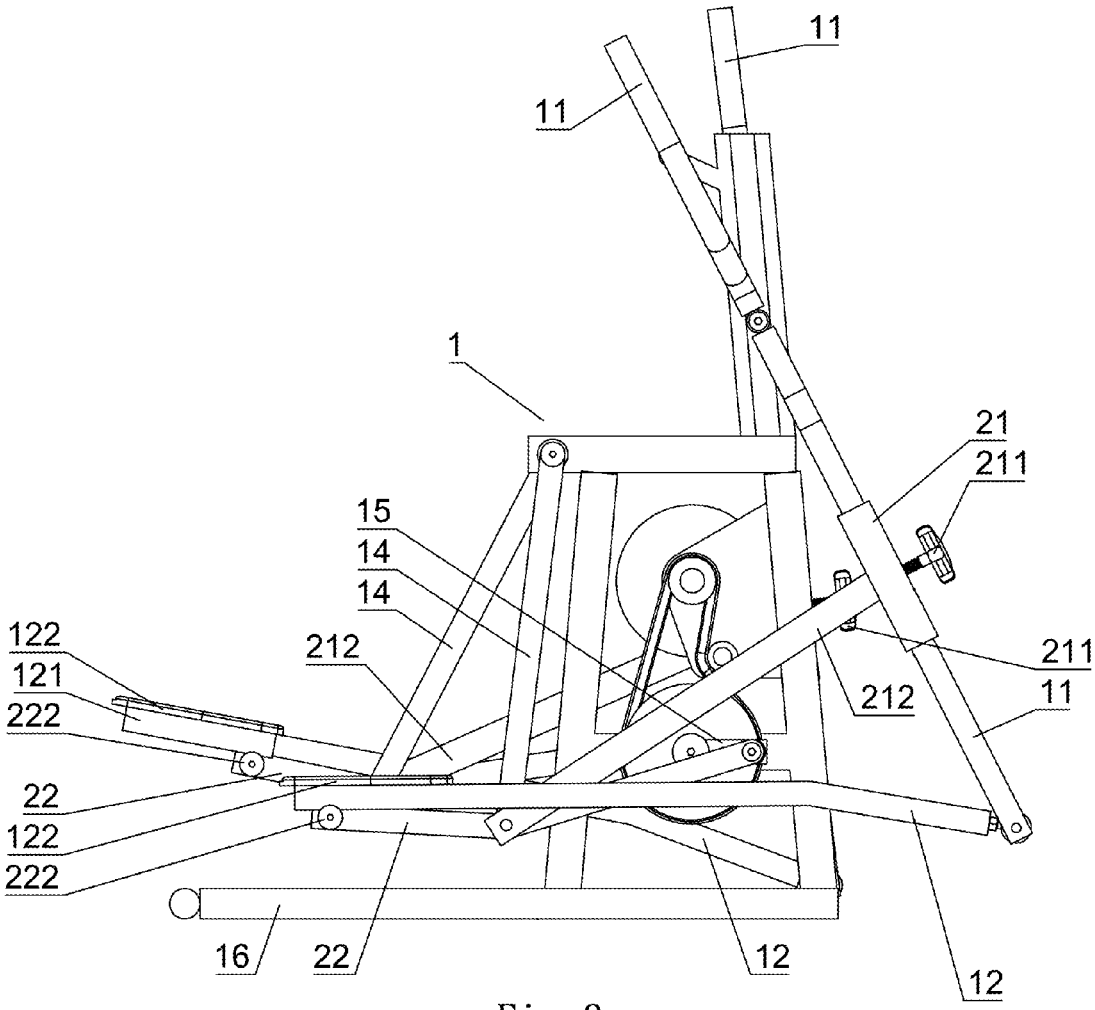
FIG. 8 is a side view showing the third preferred embodiment of the present invention.

Referring to FIGS. 7 and 8, a third preferred embodiment of the present invention is shown. The attached shaft 212 is directly and pivotally disposed to the predetermined position of the lower side of the swaying moving shaft 11 so as to connect to the axle bolt 223 at one side of the middle portion of the transmission shaft. In addition to the above concatenation of elements, the front end of the transmission shaft 22 is further pivotally connected to the crank 15, so that an oval action could be presented. The treadle frame 121 strides across the track wheel 222, and the two secondary shafts 14 pivoted to the two sides of the oval transmission structure are axially connected to the axle bolt 223. In time of the reciprocation being introduced by the feet on the treadles 122, the two cranks 15 axially trigger the front ends of the two transmission shafts 22 and relatively rotate along an oval orbit in view of the inertia force from the oval transmission structure. Concurrently, one side of the axle bolt 223 brings the attached shaft 212 and the secondary shaft 14 to move the lower portions of the two swaying moving shafts 11 for a relative displacement. The upper portion of the swaying moving shaft 11 sways oppositely for pivotally motivating the treadle frames 121 on the two push-pull shafts 12 to slide on the track wheels 222. Thereby, the secondary shaft 14 sways along with the moving manner of the push-pull shaft 12. When the crank 15 is rotated to a lowest position, the rear end of the transmission shaft 22 is positioned at a highest point. On the other hand, when the crank 15 is positioned to a highest point, the rear end of the transmission shaft 22 is placed to a lowest position. As a result, a V-shaped leverage of the transmission shaft 22 is accomplished to attain a favorable transmission effect while an alternation of the reciprocating treading and swaying of the treadles 122 and the swaying moving shafts 11 is executed, thereby preferably carrying users as well as the entire components. As a result, a stable back-and-forth reciprocation is achieved.

Figure 9:
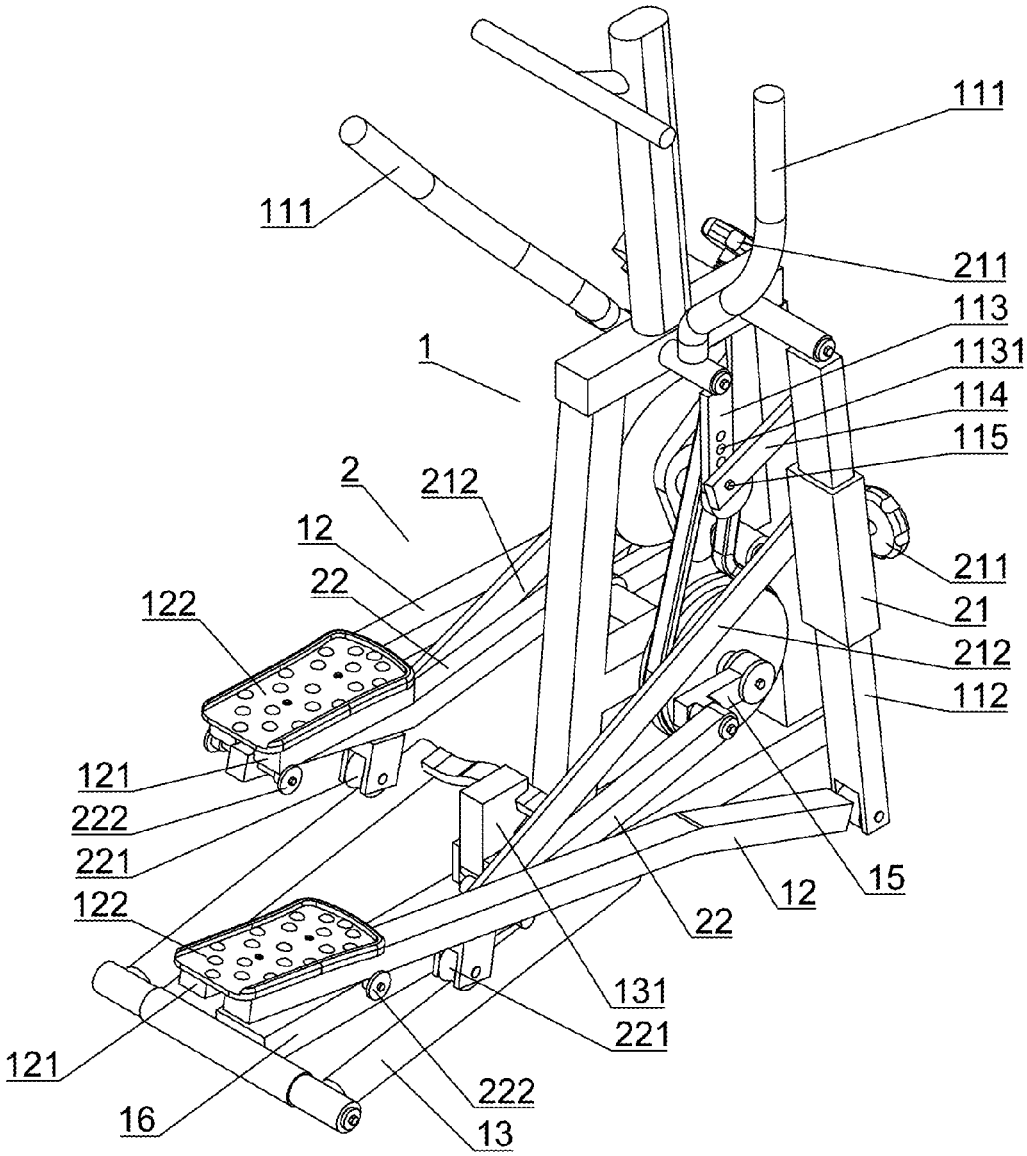
FIG. 9 is a perspective view showing a fourth preferred embodiment of the present invention.
Figure 10:
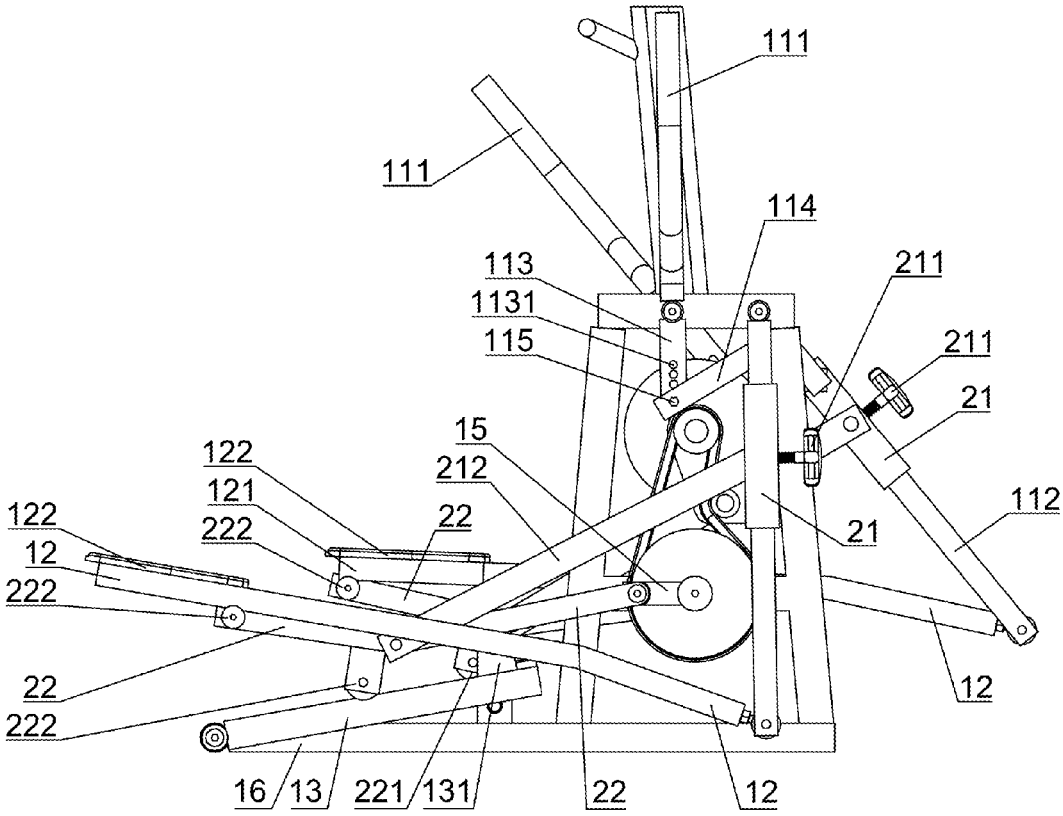
FIG. 10 is a side view showing the forth preferred embodiment of the present invention.

Referring to FIGS. 9 and 10, a fourth preferred embodiment of the present invention is shown. The united swaying moving shaft 11 is substituted by a two-sectional swaying moving shaft 11 that includes an upper holding shaft 111 and a lower swaying shaft 112. The upper holding shaft 111 pivots to two sides of the top middle of the oval transmission structure, thereby allowing an apertured board 113 with at least one aperture 1131 to be extensively formed downward an axle tube. The lower swaying shaft 112 pivots to two sides of the top front of the oval transmission structure. An adjusting board 14 with a through hole is pivoted to a side of the top portion of the lower swaying shaft. Thereby, a latch shaft 115 respectively enters into the apertures on the apertured board 113 as well as the through holes on the adjusting board 114 for a tight connection. While the feet reciprocally tread on the treadles 122, the two cranks 15 axially trigger the front portions of the two transmission shafts 22, thereby allowing a relative oval action to be achieved in view of the inertia force brought about by the oval transmission structure. The axle bolt 223 along with the attached shaft 212 triggers the sliding wheels 221 thereunder to slide on the track frame 13 reciprocally. Accordingly, the sliding block 21 carries the two lower swaying shafts 112 to achieve a relative displacement. The adjusting board 114 thereabove cooperates with the apertured board 113 to propel the upper holding shaft 111 for presenting an opposite swaying, so that the treadle frames 121 of the two push-pull shafts 12 are pivotally triggered to slide on the track wheels 222. When the crank 15 is rotated to a lowest position, the rear end of the transmission shaft 22 is positioned at a highest point. On the other hand, when the crank 15 is positioned to a highest point, the rear end of the transmission shaft 22 is placed to a lowest position. Thus, a V-shaped leverage of the transmission shaft 22 is accomplished to attain a favorable transmission effect while an alternation of the reciprocating treading and swaying of the treadles 122 and the swaying moving shafts 11 is executed to cooperate with the sliding of the slide wheels 221 on the track frame 13 thereunder. As a result, users could freely adjust the relative swaying relationship between their both hands and feet to achieve a favorable effect as that of the previous embodiments.

While we have shown and described the embodiment in accordance with the present invention, it should be clear to those skilled in the art that further embodiments may be made or modified without departing from the scope of the present invention.

I claim:

1. An oval transmission structure comprising:

a base (1) having on each of two lateral sides thereof an integral swaying moving shaft (11) that is configured to be grasped and controlled by a user's hands;

a treadle frame (121) having treadles (122) configured to be trodden by said user's feet;

a crank (15) pivotally attached to the base; and a track frame (13) disposed at a rear portion of the base wherein a lower portion of said swaying moving shaft is pivotally and serially connected to a front portion of a push-pull shaft (12), the front portion of the push-pull shaft slopes to a predetermined angle and said treadle frame straddles track wheels (222) at a rear portion of said push-pull shaft; and, an assistant device comprising:

a sliding block (21) superposing at a lower portion of each said swaying moving shafts;

a fixing bolt (211) mounted to a side of said sliding block;

an attached shaft (212) having one end pivotally attached to a side of said sliding block and an opposite end connected to an axle bolt (223) of a transmission shaft (22); and, a sliding wheel (221) disposed beneath a predetermined position of a middle section of said transmission shaft wherein a front end of said transmission shaft is pivotally coupled to said crank, a rear end of said transmission shaft is connected to said track wheels, said transmission shaft allows said axle bolt to move said attached shaft thereby permitting said sliding block to sway said swaying moving shaft and accordingly make said push-pull shaft move back and forth, said treadle frame to slide on said track wheels and said sliding wheel to slide on said track frame thereby allowing a V-shaped leverage to be accomplished such that said treadles alternately reciprocate while said swaying moving shafts sway back and forth to provide said user with a simulated climbing exercise.

2. The oval transmission structure as claimed in claim 1, wherein, said track frame comprises a frame body axially disposing on an medial portion of said base, the base further includes a block with at least one slot wherein the block is disposed on a main shaft of the base, and the placement of the track frame on the base forms a sloping track frame.

3. The oval transmission structure as claimed in claim 1, wherein, a sloping frame is formed by said track frame being directly fixed to a main shaft of the base or by said track frame being fixed to a block disposed on the base.

4. An oval transmission structure comprising:

a base (1) having on each of two lateral sides thereof a sectional swaying moving shaft (111), having an upper holding shaft (111) and a lower swaying shaft (112), that is configured to be grasped and controlled by a user's hands;

an apertured board (113) and an adjusting board (114) pivotally coupled to each other and interconnected to said upper holding shaft and said lower swaying shaft;

a treadle frame (121) having treadles (122) configured to be trodden by said user's feet;

a crank (15) pivotally attached to the base; and a track frame (13) disposed at a rear portion of the base wherein a lower portion of said swaying moving shaft is pivotally and serially connected to a front portion of a push-pull shaft (12), the front portion of the push-pull shaft slopes to a predetermined angle and said treadle frame straddles track wheels (222) at a rear portion of said push-pull shaft; and, an assistant device comprising:

a sliding block (21) superposing at a lower portion of each said swaying moving shafts;

a fixing bolt (211) mounted to a side of said sliding block;

an attached shaft (212) having one end pivotally attached to a side of said sliding block and an opposite end connected to an axle bolt (223) of a transmission shaft (22); and, a sliding wheel (221) disposed beneath a predetermined position of a middle section of said transmission shaft wherein a front end of said transmission shaft is pivotally coupled to said crank, a rear end of said transmission shaft is connected to said track wheels, said transmission shaft allows said axle bolt to move said attached shaft thereby permitting said sliding block to sway said swaying moving shaft and accordingly make said push-pull shaft move back and forth, said treadle frame to slide on said track wheels and said sliding wheel to slide on said track frame thereby allowing a V-shaped leverage to be accomplished such that said treadles alternately reciprocate while said swaying moving shafts sway back and forth to provide said user with a simulated climbing exercise.

5. The oval transmission structure as claimed in claim 4, wherein, said track frame comprises a frame body axially disposing on an medial portion of said base, the base further includes a block with at least one slot wherein the block is disposed on a main shaft of the base, and the placement of the track frame on the base forms a sloping track frame.

6. The oval transmission structure as claimed in claim 4, wherein, a sloping frame is formed by said track frame being directly fixed to a main shaft of the base or by said track frame being fixed to a block disposed on the base.

* * * * *